US011232890B2

(12) United States Patent
Nakamura

(10) Patent No.: US 11,232,890 B2
(45) **Date of Patent: *Jan. 25, 2022**

(54) RFEB SINTERED MAGNET AND METHOD FOR PRODUCING SAME

(71) Applicant: DAIDO STEEL CO., LTD., Nagoya (JP)

(72) Inventor: Michihide Nakamura, Nagoya (JP)

(73) Assignee: DAIDO STEEL CO., LTD., Nagoya (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/673,288

(22) Filed: Nov. 4, 2019

(65) Prior Publication Data

US 2020/0143965 A1 May 7, 2020

(30) Foreign Application Priority Data

Nov. 6, 2018 (JP) ..... JP2018-208615
Aug. 27, 2019 (JP) ..... JP2019-154463

(51) Int. Cl.

| | |
|---|---|
| ***H01F 1/057*** | (2006.01) |
| ***H01F 41/02*** | (2006.01) |
| ***B22F 3/16*** | (2006.01) |
| ***B22F 3/24*** | (2006.01) |
| ***C22C 28/00*** | (2006.01) |

(52) U.S. Cl.

CPC ..... *H01F 1/0577* (2013.01); *B22F 3/16* (2013.01); *B22F 3/24* (2013.01); *C22C 28/00* (2013.01); *H01F 41/0266* (2013.01); *B22F 2003/248* (2013.01); *B22F 2202/05* (2013.01); *B22F 2301/45* (2013.01)

(58) Field of Classification Search

None

See application file for complete search history.

(56) References Cited

U.S. PATENT DOCUMENTS

2004/0118484 A1 6/2004 Nishizawa et al.
2004/0166013 A1 8/2004 Nishizawa et al.
(Continued)

FOREIGN PATENT DOCUMENTS

CN 1572004 A 1/2005
CN 104078176 A 10/2014
(Continued)

OTHER PUBLICATIONS

Chinese Office Action, dated Jan. 6, 2021, in Chinese Patent Application No. 201911075229.0 and English Translation thereof.
(Continued)

*Primary Examiner* — Xiaowei Su

(74) *Attorney, Agent, or Firm* — McGinn IP Law Group, PLLC

(57) ABSTRACT

The present invention relates to an RFeB sintered magnet containing: 28% to 33% by mass of a rare-earth element R, 0% to 2.5% by mass of Co (cobalt) (i.e., Co may not be contained), 0.3% to 0.7% by mass of Al (aluminum), 0.9% to 1.2% by mass of B (Boron), and less than 1,500 ppm of O (oxygen), with the balance being Fe, containing an RFeAl phase having an $R_6Fe_{14-x}Al_x$ structure in a crystal grain boundary, and having a coercivity of 16 kOe or more.

18 Claims, 4 Drawing Sheets

(56) References Cited

U.S. PATENT DOCUMENTS

| | | | | |
|---|---|---|---|---|
| 2004/0177899 | A1 | 9/2004 | Nishizawa et al. | |
| 2004/0187962 | A1 | 9/2004 | Ishizaka et al. | |
| 2004/0187969 | A1 | 9/2004 | Ishizaka et al. | |
| 2004/0187970 | A1 | 9/2004 | Ishizaka et al. | |
| 2014/0290803 | A1 | 10/2014 | Kato et al. | |
| 2014/0314612 | A1* | 10/2014 | Nakajima | H01F 41/0293 419/38 |
| 2015/0125336 | A1 | 5/2015 | Sagawa et al. | |
| 2015/0170810 | A1* | 6/2015 | Miwa | B22F 3/10 75/246 |
| 2015/0179317 | A1 | 6/2015 | Fujikawa et al. | |
| 2017/0018342 | A1* | 1/2017 | Fukagawa | C22C 38/30 |
| 2020/0013529 | A1* | 1/2020 | Nakamura | H01F 1/0577 |

FOREIGN PATENT DOCUMENTS

| | | | |
|---|---|---|---|
| CN | 104112581 | A | 10/2014 |
| CN | 104395971 | A | 3/2015 |
| CN | 104733147 | A | 6/2015 |
| CN | 105960690 | A | 9/2016 |
| JP | 2014-132628 | A | 7/2014 |
| WO | WO 2014/017249 | A1 | 1/2014 |

OTHER PUBLICATIONS

Chinese Office Action, dated Jun. 7, 2021, in Chinese Patent Application No. 201911075229.0 and English Translation thereof.

* cited by examiner

RFEB SINTERED MAGNET AND METHOD FOR PRODUCING SAME

TECHNICAL FIELD

The present invention relates to an RFeB sintered magnet containing a rare-earth element (hereinafter referred to as "R"), iron (Fe) and boron (B) as main constituting elements.

BACKGROUND ART

RFeB sintered magnets were discovered in 1982 by Masato Sagawa et al. and have excellent characteristics that most of their magnetic characteristics such as residual magnetic flux density are far higher than those of conventional permanent magnets. Therefore, RFeB sintered magnets have been used in a variety of products, for example, various motors such as motors for automobiles such as hybrid automobiles and electric automobiles and motors for industrial machines, speakers, headphones, and magnetic resonance diagnostic devices using permanent magnet.

Earlier versions of the RFeB sintered magnet had a defect that the coercivity iHc is comparatively low among various magnetic characteristics. Later studies have revealed that the presence of a heavy rare-earth element $R^H$ such as Dy or Tb inside the RFeB sintered magnet improves the coercivity. The coercivity is a measure of the ability to withstand an external magnetic field without inverting magnetization when the external magnetic field opposite to the direction of magnetization is applied to the magnet. It is considered that the heavy rare-earth element $R^H$ has an effect of increasing the coercivity through an inhibition of the magnetization inversion. However, since the heavy rare-earth element $R^H$ is expensive and rare and also causes lowering of the residual magnetic flux density, it is not desirable to increase the content of the heavy rare-earth element $R^H$.

Patent Literature 1 describes the addition of Ga (gallium) in order to improve the coercivity of the RFeB sintered magnet without adding the heavy rare-earth element $R^H$. In general, in the RFeB sintered magnet, in the case where a ferromagnetic body having a large saturation magnetization is present in a crystal grain boundary, a magnetic interaction is generated among adjacent crystal grains. Therefore, when a reverse magnetic field (magnetic field whose direction is opposite to that of magnetization) is applied, and when the magnetization is inverted in a certain crystal grain, the magnetization of adjacent crystal grains is also inverted by such an interaction so that the coercivity is decreased. As such a ferromagnetic body having a large saturation magnetization, typical examples include one composed of R and Fe which have not been contained in the crystal grains. Contrarily, in the case where Ga (gallium) is added to the RFeB sintered magnet, a ferromagnetic body having a relatively small saturation magnetization, represented by $R_6Fe_{13}Ga$, is formed in the crystal grain boundary and the formation of a ferromagnetic body having a larger saturation magnetization is suppressed. Thereby, even when a reverse magnetic field is applied and magnetization is inverted at a certain crystal grain, the magnetic interaction that may invert the magnetization of adjacent crystal grains becomes weak, so that the coercivity is improved.

Patent Literature 1: JP-A 2014-132628

Patent Literature 2: WO 2014/017249

SUMMARY OF INVENTION

However, since Ga is also expensive, there occurs a problem that production costs increase in the case where Ga is added to the RFeB sintered magnet as described in Patent Literature 1.

An object of the present invention is to provide an RFeB sintered magnet having a high coercivity without using a heavy rare-earth element $R^H$ and Ga that are expensive additive elements as far as possible.

The RFeB sintered magnet according to the present invention, which is devised for solving the above problems, contains:

28% to 33% by mass of a rare-earth element R,

0% to 2.5% by mass of Co (cobalt) (i.e., Co may not be contained), 0.3% to 0.7% by mass of Al (aluminum), 0.9% to 1.2% by mass of B (Boron), and less than 1,500 ppm of O (oxygen), with the balance being Fe, contains an RFeAl phase having an $R_6Fe_{14-x}Al_x$ structure in a crystal grain boundary, and has a coercivity of 16 kOe or more.

The RFeAl phase having an $R_6Fe_{14-x}Al_x$ structure has a tetragonal crystal structure where the value of x may be a value ranging from 0.5 to 3.5. Moreover, a part of Fe of the RFeAl phase may be replaced by Co and also, as mentioned later, a part of Al of the RFeAl phase may be replaced by Cu in the case where the RFeB sintered magnet according to the present invention contains Cu. Furthermore, the ratio (molar ratio) of the number of R to the total number of atoms of Fe (Co) and Al (Cu) may slightly deviate from 6:14 owing to the generation of lattice defects.

As the rare-earth element R, a light rare-earth element such as Nd or Pr can be suitably used. Moreover, it is not necessary to use a heavy rare-earth element $R^H$ as the rare-earth element R. However, containing a heavy rare-earth element $R^H$ as a part of the rare-earth element R is not excluded from the present invention. That is, the present invention may contain a heavy rare-earth element $R^H$ as a part of the rare-earth element R.

The RFeB sintered magnet of the present invention may contain 0.2% by mass or less of Ga as an unavoidable impurity (not as an additive element) in addition to the above-described elements. Also, the RFeB sintered magnet of the present invention may contain 0.1% by mass or less of Cr (chromium), 0.1% by mass or less of Mn (manganese), 0.1% by mass or less of Ni (nickel), 2,000 ppm or less of N (nitrogen), and 2,000 ppm or less of C (carbon), as unavoidable impurities. It is desirable that the content of N is 1,000 ppm or less and the content of C is 1,000 ppm or less.

The RFeB sintered magnet according to the present invention can be produced through the following steps:

a step of preparing a substrate composed of an RFeB sintered body by orienting an RFeB magnet powder containing 28% to 33% by mass of a rare-earth element R, 0% to 2.5% by mass of Co (i.e., Co may not be contained), 0.3% to 0.7% by mass of Al, and 0.9% to 1.2% by mass of B, with the balance being Fe, in a magnetic field and then sintering the powder;

a first aging treatment step of heating the substrate to a first aging temperature that is a temperature falling within the range of 700° C. to 900° C.; and a second aging treatment step of heating the substrate after being subjected to the first aging treatment step, to a second aging temperature that is a temperature falling within the range of 530° C. to 580° C., in which the substrate preparation step, the first aging treatment step and the second aging treatment step are performed so that the finally obtained RFeB sintered magnet has a content of O being less than 1,500 ppm. At least a part of these steps are preferably performed in a vacuum (e.g., 10 Pa or less) or inert gas atmosphere (e.g., nitrogen gas, argon gas, etc. with at most 30 ppm of oxygen gas in a partial pressure). The substrate preparation step is preferably performed in a nitrogen gas or argon gas atmosphere with at most 30 ppm of oxygen gas in a partial pressure. The first and second aging treatment steps are preferably performed in an argon gas atmosphere or in a vacuum (10 Pa or less).

The second aging temperature can be a temperature falling within the range of 530° C. to 560° C.

In the RFeB sintered magnet according to the present invention, a substrate composed of an RFeB sintered body is manufactured by using an RFeB sintered magnet powder containing 0.3% to 0.7% by mass of Al and then, the substrate was heated to a temperature falling within the range of 700° C. to 900° C. in the first aging treatment step and further heated to a temperature falling within the range of 530° C. to 580° C., preferably within the range of 560° C. to 580° C. in the second aging treatment step. Accordingly, an RFeAl phase is formed at a crystal grain boundary. Incidentally, the RFeAl phase is not formed at the crystal grain boundary at the time when the first aging treatment step is finished. Since a magnetic interaction between Fe atoms is weakened by the replacement of a part of the Fe atom by an Al atom in the RFeAl phase, saturation magnetization becomes small.

However, in the case where a large amount of oxygen is present around the RFeB magnet powder in the substrate preparation step, a large amount of a rare earth oxide is formed in the RFeB magnet powder and, at the time when the rare earth oxide is dissolved in the sintering step, a large amount of Al is incorporated into the rare earth oxide. In the case where a large amount of Al is incorporated into the rare earth oxide as such, the RFeAl phase is not formed at a crystal grain boundary. Therefore, in the present invention, the content of O as an impurity in the finally obtained RFeB sintered magnet is controlled to less than 1,500 ppm. The content of O is desirably less than 1,000 ppm.

In the RFeB sintered magnet according to the present invention, an R-rich phase other than the RFeAl phase may be present in a crystal grain boundary. The R-rich phase is a phase in which the content of the rare-earth element is higher than that in $R_2Fe_{14}B$ that constitutes crystal grains of the RFeB sintered magnet. Examples of the R-rich phase include those in which at least one element selected from the group consisting of Fe, Co, Al, and Ga is solid-solved in a rare-earth oxide ($R_2O_3$). Fe solid-solved in the R-rich phase has ferromagnetism but, in the RFeB sintered magnet according to the present invention, since the RFeAl phase is formed in a crystal grain boundary, Fe in the crystal grain boundary is incorporated into the RFeAl phase and the concentration of Fe solid-solved in the R-rich phase can be lowered, so that saturation magnetization of the R-rich phase (i.e., saturation magnetization of Fe solid-solved therein) can be make small The R-rich phase having such a low Fe concentration is diffused over the whole crystal grain boundary by heating the substrate at 530° C. to 580° C. in the second aging treatment step. Especially, the R-rich phase can be diffused even to small spaces between two crystal grains.

As described above, in the RFeB sintered magnet according to the present invention, the RFeAl phase (and the R-rich phase) having a small saturation magnetization is present in a crystal grain boundary. Therefore, even when a reverse magnetic field is applied to the RFeB sintered magnet and the magnetization of a certain crystal grain is inverted, the action of inverting the magnetization of an adjacent crystal grain through the crystal grain boundary is weakened, so that such a high coercivity as 16 kOe or more can be achieved. Furthermore, since Al is suitably used without using any heavy rare-earth element $R^H$ and Ga as far as possible and Al is more inexpensive than them, increase in cost can be suppressed.

In the case where the value of x in $R_6Fe_{14-x}Al_x$ of the RFeAl phase is lower than 0.5, since the saturation magnetization by Fe in the RFeAl phase increases, the magnetic interaction to invert the magnetization of an adjacent crystal grain becomes strong. On the other hand, in the case where the value of x is higher than 3.5, the amount of Fe incorporated into the RFeAl phase decreases and the amount of Fe solid-solved in the R-rich phase in the crystal grain boundary accordingly increases to enlarge the saturation magnetization of the R-rich phase, so that the magnetic interaction to invert the magnetization of an adjacent crystal grain becomes strong. Therefore, in the RFeB sintered magnet according to the present invention, the value of x in $R_6Fe_{14-x}Al_x$ of the RFeAl phase is desirably controlled to the range of 0.5 to 3.5.

It is preferable that the RFeB sintered magnet according to the present invention further contains 0.1% to 0.5% by mass of Cu (copper), the total of the contents of Cu and Al exceeds 0.5% by mass, and the content of Al is larger than the content of Cu. According to this configuration, the wettability of a grain boundary phase is improved (optimized) and the grain boundary phase can be homogeneously dispersed at the second aging treatment step, so that the coercivity is more improved.

Moreover, the RFeB sintered magnet according to the present invention preferably further contains 0.05% to 0.35% by mass of Zr. According to this configuration, a squareness ratio can be made high. Here, the squareness ratio is represented by the ratio Hk90/iHc of the reverse magnetic field Hk90 when magnetization becomes 90% of residual magnetic flux density Br to the coercivity (reverse magnetic field when magnetization becomes 0) iHc in the second quadrant of magnetization curve (demagnetization curve). A higher squareness ratio means that variation of magnetization resulting from variation of a magnetic field is smaller and a magnet has more stable characteristics in a variable magnetic field.

According to the present invention, there can be obtained an RFeB sintered magnet having a high coercivity without using a heavy rare-earth element $R^H$ and Ga that are expensive additive elements as far as possible.

DESCRIPTION OF EMBODIMENTS

Figure 1:
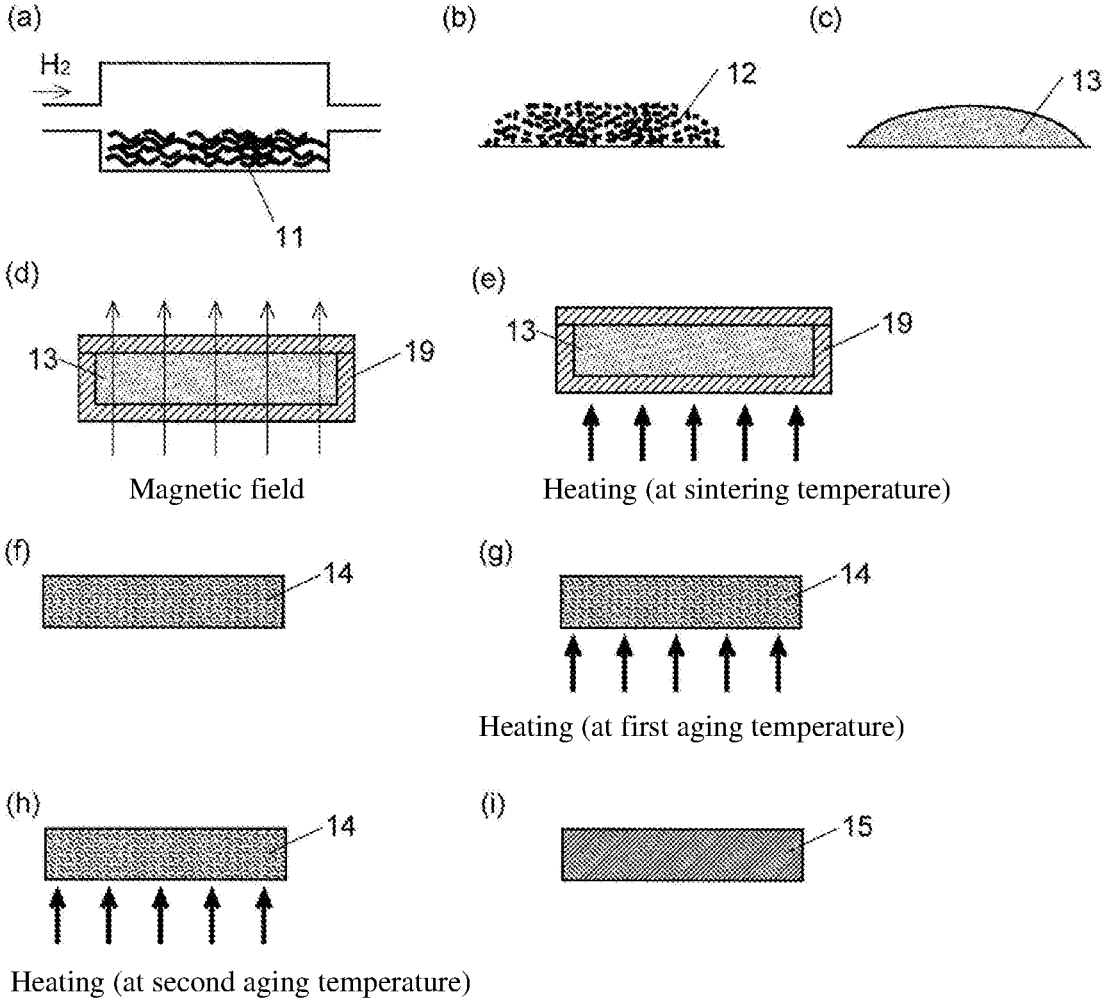
FIG. 1 is a schematic view explaining an example of the method for producing the RFeB sintered magnet according to the present invention.

Referring to FIG. 1 to FIG. 4, embodiments of the RFeB sintered magnet according to the present invention will be described.

(1) Composition:

The RFeB sintered magnet of the present embodiment contains, as a whole composition, 28% to 33% by mass, preferably 29% to 32% by mass of a rare-earth element R, 0% to 2.5% by mass, preferably 0% to 1.5% by mass of Co (cobalt), 0.3% to 0.7% by mass, preferably 0.4% to 0.5% of Al (aluminum), and 0.9% to 1.2% by mass of B (boron), and less than 1,500 ppm, preferably less than 1,000 ppm of O (oxygen), and contains Fe (iron) as the balance. Co may not be contained. As the rare-earth element R, a light rare-earth element such as Nd or Pr can be suitably used. Moreover, it is not necessary to use a heavy rare-earth element $R^H$ as the rare-earth element R. However, the RFeB sintered magnet of the present embodiment may contain a heavy rare-earth element $R^H$ as a part of the rare-earth element R. Furthermore, the RFeB sintered magnet of the present embodiment may further contain, in addition to these elements, 0.1% to 0.5% by mass of Cu and/or 0.05% to 0.35% by mass of Zr. In the case of containing Cu, it is preferable that the total of the contents of Cu and Al exceeds 0.5% by mass and the content of Al is larger than the content of Cu. Moreover, in addition to these elements, the RFeB sintered magnet of the present embodiment may further contain aforementioned unavoidable impurities.

The crystal grain boundary of the RFeB sintered magnet of the present embodiment contains an RFeAl phase and may further contain an R-rich phase. The RFeAl phase has a composition represented by $R_6Fe_{14-x}Al_x$ ($0.5 \leq x \leq 3.5$). Typical examples of the R-rich phase include a phase in which at least one element selected from the group consisting of Fe, Co, Al, and Ga is solid-solved in $R_2O_3$. Here, the concentration of Fe solid-solved in the R-rich phase becomes lower than the concentration of Fe solid-solved in the R-rich phase in the crystal grain boundary of conventional RFeB sintered magnets owing to the incorporation of Fe into the RFeAl phase.

(2) Production Method:

The RFeB sintered magnet of the present embodiment can be produced by the method to be described below. Each step to be mentioned below is performed so that the finally obtained RFeB sintered magnet has a content of O being less than 1,500 ppm, and at least a part of these steps is preferably performed under vacuum or in an inert gas atmosphere.

First, an RFeB alloy lump 11 containing an rare-earth element R, Co (which may not be contained), Al, B and Fe, and, if necessary, Cu and/or Zr in the same contents as those of the RFeB sintered magnet to be produced is prepared, for example, by a strip-cast method. Next, the RFeB alloy lump 11 is exposed to a hydrogen gas to occlude hydrogen molecules ((a) of FIG. 1). Thereby, the RFeB alloy lump 11 is embrittled. The thus embrittled RFeB alloy lump 11 is mechanically pulverized (rough pulverization) to prepare an RFeB rough powder 12 ((b) of FIG. 1). Furthermore, the RFeB rough powder 12 is finely pulverized by means of a jet mill so as to achieve such a particle size distribution that the medium value D50 of particle size becomes 3 μm or smaller, to thereby prepare an RFeB magnet powder 13 ((c) of FIG. 1). In the particles of the prepared RFeB magnet powder 13, a part of the hydrogen molecules occluded in the RFeB alloy lump 11 remain Next, the RFeB magnet powder 13 is accommodated in a mold 19 having a shape corresponding to the RFeB sintered magnet to be produced. A magnetic field is applied to the RFeB magnet powder 13 in the mold 19 to orient the RFeB magnet powder 13 ((d) of FIG. 1). Subsequently, the oriented RFeB magnet powder 13 is heated to a predetermined sintering temperature (preferably a temperature falling within the range of 900° C. to 1,050° C.) in a state of being still accommodated in the mold 19 ((e) of FIG. 1), to sinter the RFeB magnet powder 13. In this manner, a substrate 14 composed of the RFeB sintered body is obtained ((f) of FIG. 1). These operations so far correspond to the above-described substrate preparation step.

Here, the hydrogen molecules contained in the grains of the RFeB magnet powder 13 are released to the outside by the heating for sintering. On the occasion, carbon present in the RFeB magnet powder 13 as an impurity reacts with the hydrogen molecules to form a gas. Carbon can be removed from the RFeB magnet powder 13 in this manner In this case, in order to reduce or prevent the elimination of the hydrogen molecules from the grains of the RFeB magnet powder 13 before the reaction with carbon, it is preferable that operations performed in a temperature range of from room temperature to a predetermined temperature (e.g., 450° C.) in the course of elevating temperature to a sintering temperature are performed in an inert gas atmosphere, and thereafter the temperature is elevated to the sintering temperature in a vacuum atmosphere. Here, the purpose of employing a vacuum atmosphere is to remove the gas generated by the reaction of the hydrogen molecules with carbon. The mold 19 used can be made of a material having thermal resistance capable of withstanding at the sintering temperature.

At the time of manufacturing the RFeB sintered body, compression molding is generally performed (press process) during or after orientation of the RFeB magnet powder in a magnetic field. In the present embodiment, however, the RFeB magnet powder 13 is sintered without performing compression molding during or after the orientation of the RFeB magnet powder (PLP (press-less process)). In the PLP, since it is not necessary to use a press machine for performing compression molding, working space can be made small. Therefore, it is easy to make the working space an inert gas atmosphere or a vacuum atmosphere. Then, even in the case where the grain size of the RFeB magnet powder 13 is made small (the surface area of the grains is made large), the oxidation of the RFeB magnet powder 13 hardly proceeds. Therefore, the oxygen content of the prepared substrate can be decreased and thus, a rare-earth oxide is hardly formed in the substrate. Accordingly, Al is hardly incorporated into the rare-earth oxide, so that the RFeAl phase can be formed at the crystal grain boundary. Moreover, when the average grain size of the RFeB magnet powder 13 becomes close to the average gran size of the crystal grains in the obtained RFeB sintered magnet by making the grain size of the RFeB magnet powder 13 small, the average grain size of the crystal grains in the RFeB sintered magnet also decreases as the average grain size of the RFeB magnet powder 13 decreases, whereby the coercivity of the RFeB sintered magnet can be improved. Incidentally, the RFeB sintered magnet according to the present invention can be also manufactured by using a press process but, as mentioned so far, it is desirable to use the PLP for decreasing the oxygen content of the substrate.

After the substrate 14 is prepared as mentioned above, the substrate 14 is once cooled to room temperature and then heated to a first aging temperature that is a temperature falling within the range of 700° C. to 900° C. ((g) of FIG. 1, first aging treatment step). Here, the time for which the substrate 14 is maintained at the first aging temperature is not particularly limited. According to the experimental results obtained by the present inventor, even in the case where the time for which the substrate 14 is maintained at the first aging temperature is almost 0 minute, that is, the temperature is lowered just after reaching the first aging temperature, the RFeB sintered magnet obtained through the subsequent second aging treatment step has a coercivity of more than 16 kOe. Considering the production efficiency, the time for which the substrate 14 is maintained at the first aging temperature may be more than 0 minute, preferably 30 minutes or more, and 540 minutes or less.

Next, the substrate 14 subjected to the first aging treatment step is heated to a second aging temperature that is a temperature falling within the range of 530° C. to 580° C., preferably 560° C. to 580° C. ((h) of FIG. 1, second aging treatment step). The second aging treatment step may be performed, for example, after the substrate 14 on which the first aging treatment step has been conducted is cooled to 300° C. or lower. Here, the time for which the substrate 14 is maintained at the second aging temperature is not particularly limited. According to the experimental results obtained by the present inventor, even in the case where the time for which the substrate 14 is maintained at the second aging temperature is almost 0 minute, that is, the temperature is lowered just after reaching the second aging temperature, the obtained RFeB sintered magnet has a coercivity of more than 16 kOe. Considering the production efficiency, the time for which the substrate 14 is maintained at the second aging temperature may be more than 0 minute, preferably 10 minutes or more, and 540 minutes or less. Thereafter, the substrate 14 is cooled to room temperature.

In this manner, the RFeB sintered magnet 15 of the present embodiment can be obtained ((i) of FIG. 1).

EXAMPLES (3) Examples of RFeB Sintered Magnet of Present Embodiment

Examples of producing the RFeB sintered magnet of the present embodiment will be described below.

Seven kinds of RFeB alloy lumps each having the respective composition (measurement values) described in Table 1 were each manufactured by a strip casting method (hereinafter referred to as alloys 1 to 7). Here, "IRE" in Table 1 means the sum of the contents of all rare-earth elements (Total Rare-Earth) and here, is the sum of the contents of Nd (neodymium), Pr (praseodymium), Dy (dysprosium), and Tb (terbium). Incidentally, rare-earth elements other than these four kinds are not contained in the alloys 1 to 7 except for those contained as unavoidable impurities. The alloys 1 to 7 may contain unavoidable impurities in addition to the elements mentioned in Table 1.

TABLE 1

Composition of Alloy as Raw Material (unit: % by mass) and Second Aging Temperature (unit: ° C.)

| | Nd | Pr | Dy | Tb | Co | B | Al | Cu | Zr | Ga | Fe | Second aging temperature |
|---|---|---|---|---|---|---|---|---|---|---|---|---|
| Alloy 1 | 27.2 | 4.77 | 0 | 0 | 0.90 | 0.97 | 0.43 | 0.12 | 0 | 0 | balance | 540 |
| | | TRE: 32.0 | | | | | | | | | | |
| Alloy 2 | 27.2 | 4.80 | 0 | 0 | 0.90 | 0.97 | 0.71 | 0.12 | 0 | 0 | balance | 560 |
| | | TRE: 32.0 | | | | | | | | | | |
| Alloy 3 | 27.2 | 4.80 | 0 | 0 | 0.91 | 0.95 | 0.46 | 0.12 | 0.08 | 0 | balance | 560 |
| | | TRE: 32.0 | | | | | | | | | | |
| Alloy 4 | 27.2 | 4.81 | 0 | 0 | 1.92 | 0.95 | 0.43 | 0.12 | 0.11 | 0 | balance | 540 |
| | | TRE: 32.0 | | | | | | | | | | |
| Alloy 5 | 27.7 | 4.82 | 0 | 0 | 1.91 | 0.96 | 0.43 | 0.12 | 0.11 | 0 | balance | 540 |
| | | TRE: 32.5 | | | | | | | | | | |
| Alloy 6 | 27.1 | 4.78 | 0 | 0 | 0.90 | 0.97 | 0.33 | 0.12 | 0 | 0 | balance | 540 |
| | | TRE: 31.9 | | | | | | | | | | |
| Alloy 7 | 26.0 | 4.83 | 2.55 | 0 | 1.40 | 0.97 | 0.39 | 0.23 | 0 | 0 | balance | 540 |
| | | TRE: 33.4 | | | | | | | | | | |
| Alloy A | 26.9 | 4.85 | 0 | 0 | 0.91 | 0.97 | 0.16 | 0.13 | 0 | 0 | balance | 520 |
| | | TRE: 31.8 | | | | | | | | | | |

Each of the alloys 1 to 7 was subjected to a rough pulverization and a fine pulverization under the aforementioned conditions, to thereby prepare the respective RFeB magnet powder 13. The RFeB magnet powder 13 was filled into a mold 19 so that filling density be 3.4 g/cm$^3$ and then, the RFeB magnet powder 13 was oriented in a magnetic field. Subsequently, the RFeB magnet powder 13 was heated from room temperature to a sintering temperature between 985° C. and 995° C. while being still filled in the mold 19, maintained at the temperature for 4 hours and then, cooled to room temperature, thereby preparing a substrate 14. The sintering was performed in an argon gas atmosphere from room temperature to 450° C. and thereafter performed in a vacuum atmosphere (10 Pa or less). The respective substrate 14 obtained from the alloys 1 to 7 was heated at a first aging temperature of 800° C. for 30 minutes, lowered in temperature to a second aging temperature that was 540° C. or 560° C. (described in Table 1 for each alloy) and then maintained for 90 minutes at that temperature, followed by rapidly cooling, to thereby produce an RFeB sintered magnet 15. The RFeB sintered magnets manufactured from the alloys 1 to 7 were called samples of Examples 1 to 7, respectively.

In addition, as Comparative Example 1, an RFeB sintered magnet was manufactured in the same manner as in Example 1 by using the alloy 1 except that the content of O was made larger than that of Examples 1 to 7 and Comparative Example 2. In addition, as Comparative Examples 2 and 3, RFeB sintered magnets were manufactured in the same manner as in Example 1 except for using an alloy A having the composition described in Table 1. The RFeB sintered magnet of Comparative Example 3 was manufactured so as to have a higher content of O than that of Examples 1 to 7 and Comparative Example 2. Here, the content of O in the obtained RFeB sintered magnet can be adjusted by controlling the production environment in the steps from the pulverization of the RFeB ally lump 11 to the filling of the RFeB magnetic powder 13 into the mold 19. The second aging temperature was 540° C. (Comparative Example 1) or 520° C. (Comparative Examples 2 and 3). The alloy A has a content of Al of 0.16% by mass, which falls outside the range of the composition of the RFeB sintered magnet of the present invention.

Table 2 shows the results of measuring the composition of the manufactured samples of Examples 1 to 7 and Comparative Examples 1 to 3. Moreover, Table 3 shows coercivity iHc, squareness ratio SQ, and values of Hk90 measured for determining the squareness ratio SQ of each of these samples. Here, Hk90 is a value of reverse magnetic field at the time when magnetization becomes 90% of residual magnetic flux density Br, in the second quadrant of the magnetization curve (demagnetization curve). The squareness ratio SQ is determined by Hk90/iHc.

TABLE 2

Composition of Obtained RFeB Sintered Magnet (unit: ppm for O, % by mass for other elements)

| | Nd | Pr | Dy | Tb | Co | B | Al | Cu | Zr | Ga | O | Fe |
|---|---|---|---|---|---|---|---|---|---|---|---|---|
| Example 1 | 26.6 | 4.50 | 0 | 0 | 1.00 | 0.97 | 0.42 | 0.11 | 0 | 0 | 822 | balance |
| | | TRE: 31.1 | | | | | | | | | | |
| Example 2 | 26.5 | 4.60 | 0 | 0 | 0.93 | 0.97 | 0.66 | 0.11 | 0 | 0 | 611 | balance |
| | | TRE: 31.1 | | | | | | | | | | |
| Example 3 | 26.8 | 4.65 | 0 | 0 | 0.90 | 0.96 | 0.47 | 0.11 | 0.08 | 0 | 610 | balance |
| | | TRE: 31.5 | | | | | | | | | | |
| Example 4 | 26.8 | 4.68 | 0 | 0 | 1.80 | 0.96 | 0.45 | 0.11 | 0.11 | 0 | 562 | balance |
| | | TRE: 31.5 | | | | | | | | | | |
| Example 5 | 267.1 | 4.65 | 0 | 0 | 1.87 | 0.97 | 0.45 | 0.11 | 0.10 | 0 | 612 | balance |
| | | TRE: 31.8 | | | | | | | | | | |
| Example 6 | 26.6 | 4.60 | 0 | 0 | 0.90 | 0.97 | 0.32 | 0.12 | 0 | 0 | 650 | balance |
| | | TRE: 31.2 | | | | | | | | | | |
| Example 7 | 25.0 | 4.58 | 2.50 | 0 | 1.41 | 0.98 | 0.36 | 0.21 | 0 | 0 | 664 | balance |
| | | TRE: 32.1 | | | | | | | | | | |
| Comparative Example 1 | 26.6 | 4.50 | 0 | 0 | 0.90 | 0.97 | 0.41 | 0.12 | 0 | 0 | 2500 | balance |
| | | TRE: 31.1 | | | | | | | | | | |
| Comparative Example 2 | 26.3 | 4.50 | 0 | 0 | 0.90 | 0.97 | 0.15 | 0.12 | 0 | 0 | 650 | balance |
| | | TRE: 30.8 | | | | | | | | | | |
| Comparative Example 3 | 26.4 | 4.62 | 0 | 0 | 0.91 | 0.97 | 0.16 | 0.12 | 0 | 0 | 1734 | balance |
| | | TRE: 31.0 | | | | | | | | | | |

TABLE 3

Magnetic Characteristics of Obtained RFeB Sintered Magnet

| | Coercivity iHc (kOe) | Hk90 (kOe) | Squareness ratio SQ (%) |
|---|---|---|---|
| Example 1 | 17.7 | 16.4 | 92.8 |
| Example 2 | 18.2 | 16.9 | 92.5 |
| Example 3 | 18.0 | 17.1 | 95.4 |
| Example 4 | 16.8 | 15.9 | 94.6 |
| Example 5 | 17.0 | 16.2 | 95.1 |
| Example 6 | 17.3 | 16.1 | 93.0 |
| Example 7 | 21.9 | 21.1 | 96.6 |
| Comparative Example 1 | 14.5 | 15.0 | 89.2 |
| Comparative Example 2 | 15.5 | 14.3 | 92.3 |
| Comparative Example 3 | 15.7 | 14.5 | 92.4 |

In all of the samples of Examples 1 to 7, the composition of elements mentioned in Table 2 satisfies the compositional requirement in the RFeB sintered magnet of the present invention. In contrast, in the samples of Comparative Examples 1 and 3, the content of 0 does not satisfy the requirement of the present invention (i.e., less than 1,500 ppm). Moreover, in the samples of Comparative Examples 2 and 3, the content of Al does not satisfy the requirement of the present invention (i.e., 0.3% to 0.7% by mass). On the other hand, in the samples of Comparative Examples 2 and 3, the contents of the elements other than Al and O are very close to the respective contents of the elements in the sample of Example 2.

Among these Examples, when the samples of Examples 1 to 6 where Dy is not contained are compared with the samples of Comparative Examples in the coercivity iHc, all of the samples of Examples 1 to 6 showed the coercivity of from 16.8 kOe to 18.2 kOe that are larger than 16.0 kOe, but all of the samples of Comparative Examples 1 to 3 showed the coercivity of from 14.5 kOe to 15.7 kOe that are smaller than 16.0 kOe. Particularly, the sample of Example 2 where the contents of the elements other than Al and O are very close to those in Comparative Examples 2 and 3 as mentioned above showed such a high coercivity iHc as 18.2 kOe, which is remarkably higher than that in Comparative Examples 2 and 3.

Moreover, the samples of Examples 3 to 5 contains 0.08% to 0.11% by mass of Zr and showed the values of the squareness ratio SQ being higher (94.6% to 95.4%) than those in the other samples (Examples 1 and 2 and Comparative Examples 1 to 3). The sample of Example 7 contains 2.50% by mass of Dy and showed the value of the coercivity iHc being higher than the values in the other samples.

Figure 2:
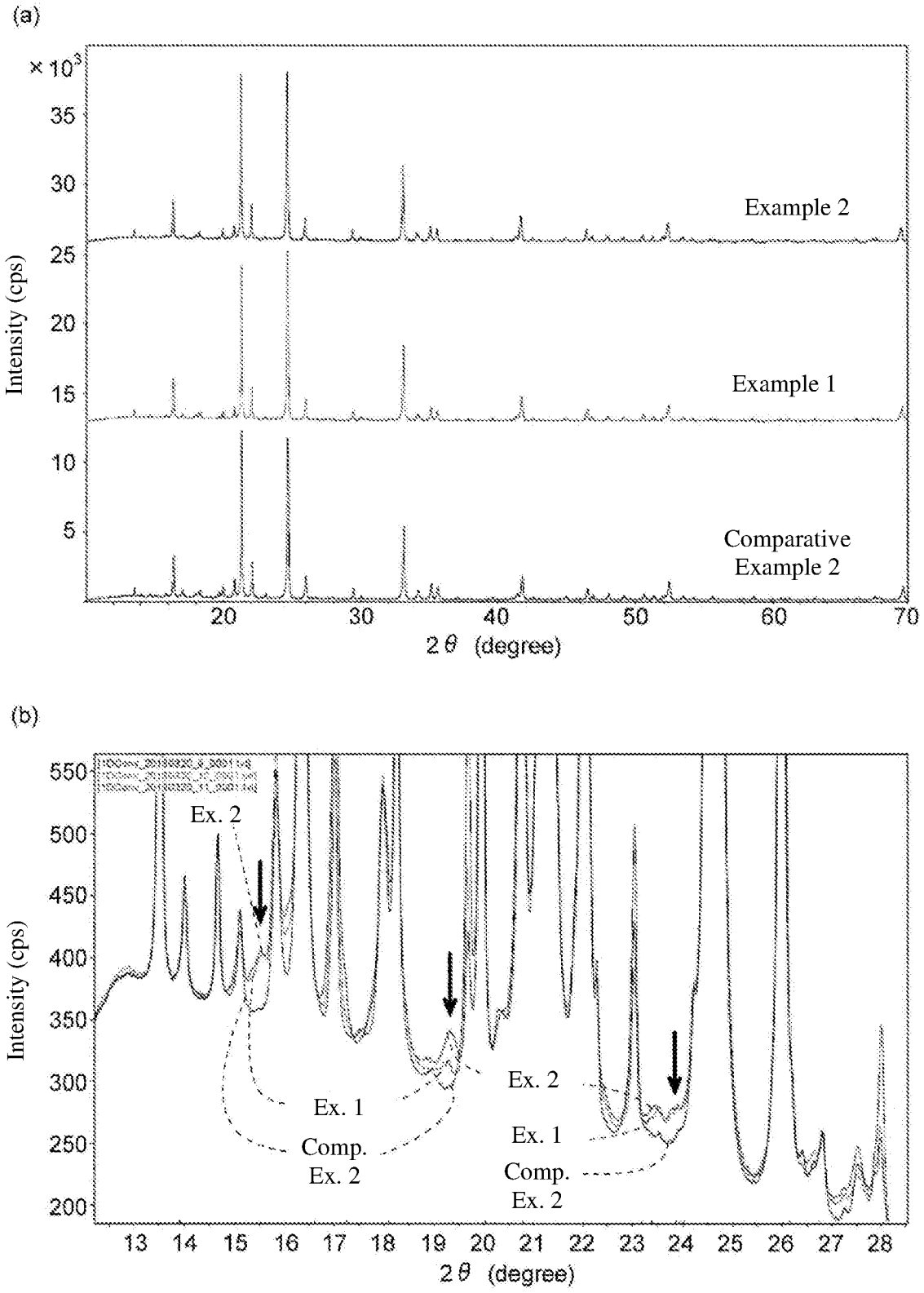
FIG. 2 includes a graph (a) showing results of radiation light X-ray diffraction measurement for samples of Examples 1 and 2 and Comparative Example 2, and a partial enlarged view (b) thereof.

Next, an X-ray diffraction measurement was performed for the samples of Examples 1 and 2 and Comparative Example 2, and the results thereof are shown in FIG. 2. This measurement was performed with a radiation ray having a wavelength of 0.09 nm by using a radiation ray X-ray diffraction measurement device in Aichi Synchrotron Radiation Center (Aichi Science and Technology Foundation). The graph of (a) of FIG. 2 shows the measurement results of the samples in the range where 2θ is from 10° to 70° for each sample and, in (b) of FIG. 2, the abscissa (2θ) and the ordinate (intensity) are partially expanded and data of three samples are superimposed and displayed. At the portions shown by arrows in (b) of FIG. 2, there are three peaks which appear in Examples 1 and 2 and does not appear in Comparative Example. These three peaks are well coincident with the X-ray diffraction pattern (PDF #01-078-9291) of $Nd_6Fe_{11}Al_3$ (R=Nd and x=3 in $R_6Fe_{14-x}Al_x$) collected in the powder diffraction database "PDF" (Powder Diffraction File) managed by International Centre for Diffraction Data (ICDD). These data mean that the phase having the same crystal structure as that of $R_6Fe_{14-x}Al_x$, i.e., an RFeAl phase is contained in the samples of Examples 1 and 2.

Next, the sample of Example 2 was subjected to an analysis using a wavelength dispersive X-ray spectroscopy (WDX), and in six measurement points arbitrarily selected in crystal grain boundaries and containing all of three elements of R, Fe and Al, compositional ratios of these three kinds of elements, Co and Cu were determined. Table 4 shows the results.

TABLE 4

Composition Analysis of Grain Boundary of Obtained RFeB Sintered Magnet

| Measurement Point No. | Composition (unit: atom %) R | Fe | Co | Al | Cu | R:(Fe + Co): (Al + Cu) | R:(Fe + Co + Al + Cu) |
|---|---|---|---|---|---|---|---|
| 1 | 29.5 | 57.0 | 3.9 | 7.5 | 2.1 | 6:12.4:1.9 | 6:14.3 |
| 2 | 29.3 | 56.6 | 3.5 | 8.0 | 2.6 | 6:12.3:2.2 | 6:14.5 |
| 3 | 30.0 | 54.5 | 4.9 | 8.4 | 2.2 | 6:11.9:2.1 | 6:14.0 |
| 4 | 29.7 | 55.4 | 4.0 | 8.4 | 2.5 | 6:12.0:2.2 | 6:14.2 |
| 5 | 28.3 | 56.2 | 3.8 | 9.2 | 2.5 | 6:12.7:2.5 | 6:15.2 |
| 6 | 29.1 | 57.1 | 3.7 | 8.0 | 2.1 | 6:12.5:2.1 | 6:14.6 |

In these six measurement points, the ratio of the content of the R atom to the sum of the contents of four atoms of Fe, Co, Al, and Cu is close to 6:14 and thus, it is considered that an RFeAl phase was formed in crystal grain boundaries.

In the case where an RFeAl phase is formed in a crystal grain boundary, the amount of Fe solid-solved in the R-rich phase is decreased. Since magnetic interaction among crystal grains is decreased due to the small saturation magnetization of the RFeAl phase and due to the small amount of Fe solid-solved in the R-rich phase, the coercivity of the RFeB sintered magnet of the present embodiment becomes high.

Next, by using the substrate 14 prepared from the RFeB magnet powder obtained from the alloy 3, samples were prepared under a plurality of conditions varying in the temperature and heating time in the first aging treatment step and the second aging treatment step, and coercivity was measured for each samples. The following describes the results.

Figure 3:
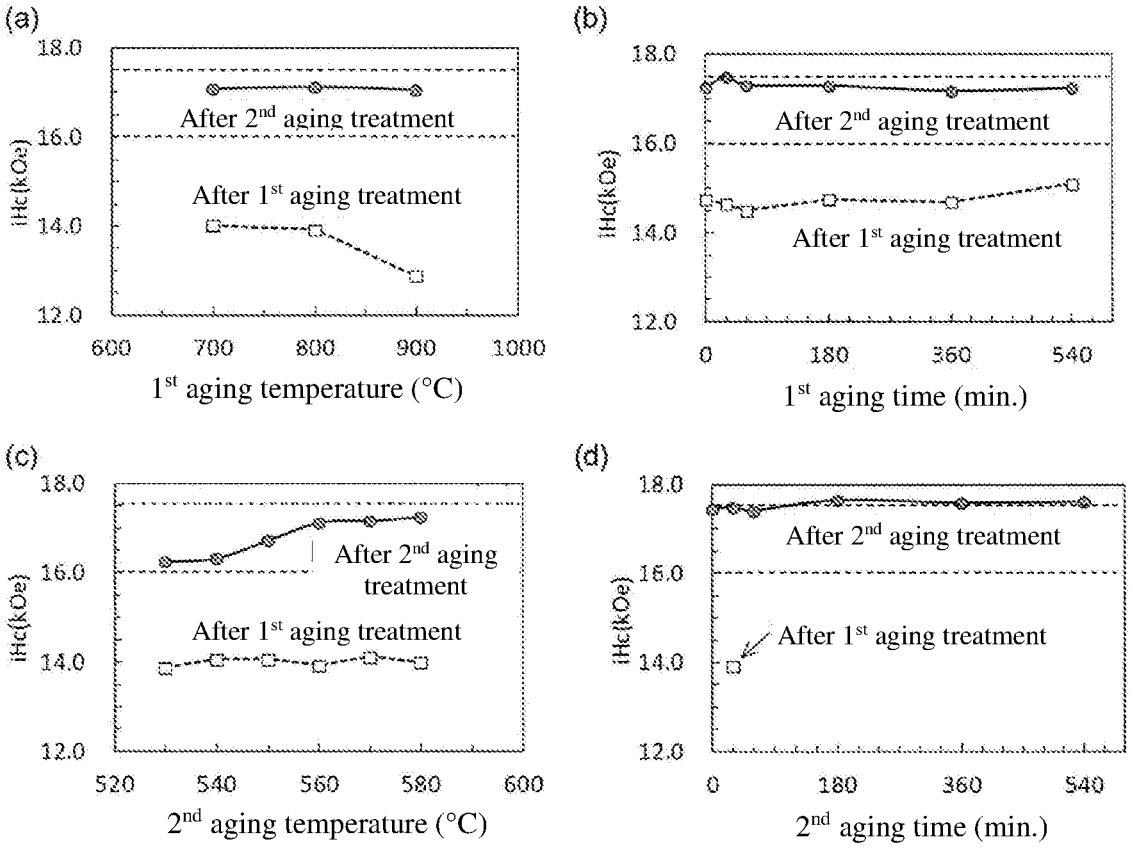
FIG. 3 includes graphs showing results of measuring coercivity for a plurality of samples which are each an RFeB sintered magnet of the present embodiment manufactured by using an alloy 3, and the graphs respectively vary in: (a) the first aging temperature; (b) the heating time in the first aging treatment step; (c) the second aging temperature; and (d) the heating time in the second aging treatment step.

The graph of (a) of FIG. 3 shows the coercivity of the samples manufactured under three conditions varying in the first aging temperature of 700° C., 800° C., or 900° C. after the first aging treatment step (before the second aging treatment step) and the coercivity of the RFeB sintered magnets (after the second aging treatment step) obtained therefrom, respectively. In all of these three samples, the heating time in the first aging treatment step was 30 minutes, the second aging temperature was 560° C., and the heating time in the second aging treatment step was 30 minutes. According to the test results, the coercivity of the obtained RFeB sintered magnets was more than 16 kOe in all cases and was almost the same with each other regardless of the first aging temperature within the above-mentioned range.

The graph of (b) of FIG. 3 shows the coercivity of the samples manufactured under six conditions varying in the heating time in the first aging treatment step within the range of 0 to 540 minutes after the first aging treatment step and the coercivity of the RFeB sintered magnets obtained therefrom, respectively. In all of these six samples, the first aging temperature was 800° C., the second aging temperature was 560° C., and the heating time in the second aging treatment step was 30 minutes. According to the test results, the coercivity of the obtained RFeB sintered magnets was more than 16 kOe in all cases and was almost the same with each other regardless of the heating time in the first aging treatment step within the above-mentioned range.

The graph of (c) of FIG. 3 shows the coercivity of the samples manufactured under six conditions varying in the second aging temperature within the range of 530° C. to 580° C. after the first aging treatment step and the coercivity of the RFeB sintered magnets obtained therefrom, respectively. In all of these six samples, the first aging temperature was 800° C., the heating time in the first aging treatment step was 30 minutes, and the heating time in the second aging treatment step was 30 minutes. According to the test results, the coercivity of the obtained RFeB sintered magnets was more than 16 kOe in all cases, and the higher the second aging temperature was, the larger the coercivity was, within the above-mentioned range.

The graph of (d) of FIG. 3 shows the coercivity of the samples manufactured under six conditions varying in the heating time in the second aging treatment step within the range of 0 to 540 minutes after the first aging treatment step and the coercivity of the RFeB sintered magnets obtained therefrom, respectively. In all of these six samples, the first aging temperature was 800° C., the heating time in the first aging treatment step was 30 minutes, and the second aging temperature was 560° C. According to the test results, the coercivity of the obtained RFeB sintered magnets was more than 16 kOe in all cases and was almost the same with each other regardless of the heating time in the second aging treatment step within the above-mentioned range.

As described above, from the experimental results shown in FIG. 3, it is found that the heating time in the first and second aging treatment steps and the first aging temperature hardly influence on the magnitude of coercivity in the obtained RFeB sintered magnet of the present embodiment and the coercivity can be further improved by adjusting the second aging temperature.

Figure 4:
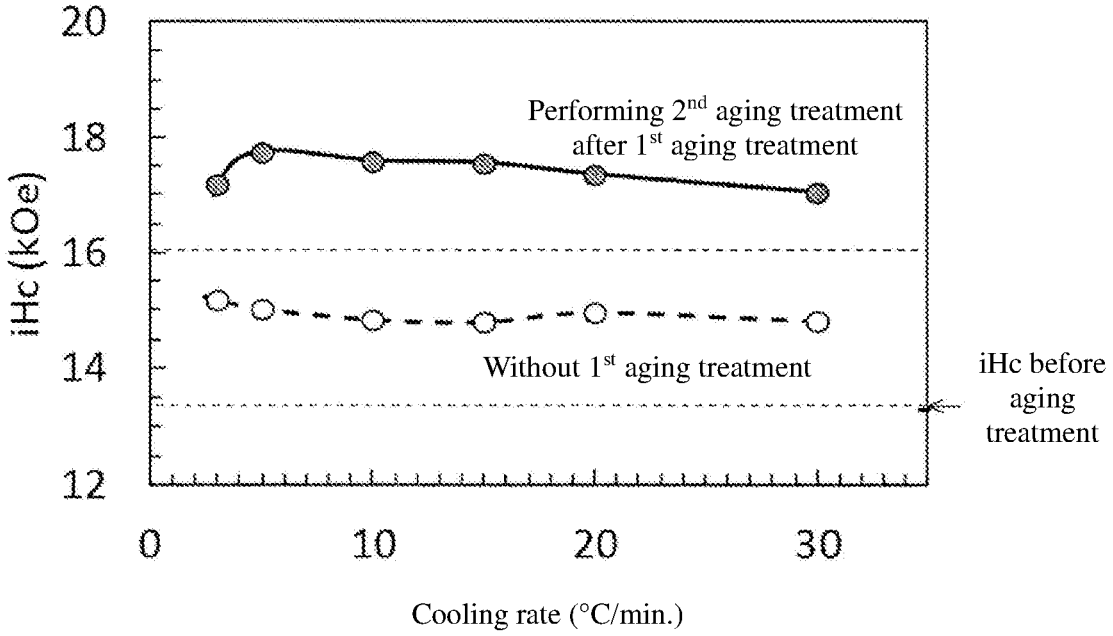
FIG. 4 is a graph showing results of measuring coercivity for a plurality of samples which are each an RFeB sintered magnet of the present embodiment manufactured by using an alloy 3 and varying in the cooling rate after the second aging treatment step.

Next, the substrate 14 prepared by using the RFeB magnet powder obtained from the alloy 3 was subjected to an aging treatment where the first aging temperature was 800° C., the heating time at the first aging treatment step was 30 minutes, the second aging temperature was 540° C., and the heating time in the second aging treatment step (the time for which temperature was maintained at 540° C.) was 30 minutes. Thereafter, samples of the RFeB sintered magnet were manufactured for a plurality of examples varying in a cooling rate at the time of cooling the substrate 14 from the second aging temperature to 100° C. In addition, as Comparative Examples, for the case where the substrate 14 prepared by using the RFeB magnet powder obtained from the alloy 3 was subjected to the second aging treatment step without being subjected to the first aging treatment step, a plurality of samples of the RFeB sintered magnet were manufactured similarly varying in the cooling rate. FIG. 4 shows the results of measuring coercivity for these samples of the RFeB sintered magnets. As a result, all of the samples of Comparative Examples showed a coercivity of less than 16 kOe, but all of the samples of Examples which were subjected to both of the first aging treatment step and the second aging treatment step showed a coercivity exceeding 16 kOe. Among Examples, the sample where the cooling rate from the second aging temperature to 100° C. was the lowest (3° C./minute) showed a slightly low coercivity as compared with the other samples where the cooling rate was 5° C./minute or more. That is, the cooling rate from the second aging temperature to 100° C. is preferably 5° C./minute or more.

The present invention have been described above based on embodiments and Examples but specific configurations should not be construed as being limited to these embodiments and Examples. The scope of the present invention is shown by not only the description of the embodiments and Examples mentioned above but also Claims, and all changes within meanings and scopes equivalent to Claims are included therein.

The present application is based on Japanese Patent Application No. 2018-208615 filed on Nov. 6, 2018 and Japanese Patent Application No. 2019-154463 filed on Aug. 27, 2019, and the contents thereof are incorporated herein by reference.

DESCRIPTION OF REFERENCE NUMERALS

11: RFeB alloy lump
12: RFeB rough powder
13: RFeB magnet powder
14: Substrate
15: RFeB sintered magnet
19: Mold

What is claimed is:

1. An RFeB sintered magnet, consisting of:
28% to 33% by mass of a rare-earth element R;
0.90% to 2.5% by mass of Co;
0.3% to 0.7% by mass of Al;
0.96% to 1.2% by mass of B;
less than 1,500 ppm of O;
0.1% to 0.5% by mass of Cu; and
0.35% by mass or less of Zr,
with the balance being Fe,
comprising an RFeAl phase having an $R_6Fe_{14-x}Al_x$ structure in a crystal grain boundary, and
having a coercivity of 17 kOe or more,
wherein a total of contents of Cu and Al exceeds 0.5% by mass.

2. The RFeB sintered magnet according to claim 1, wherein the content of Al is larger than the content of Cu.

3. The RFeB sintered magnet according to claim 1, wherein Zr is provided in a range from 0.05% to 0.35% by mass.

4. The RFeB sintered magnet according to claim 1, wherein the rare-earth element R comprises at least one element selected from the group consisting of Nd, Pr, Dy, and Tb.

5. The RFeB sintered magnet according to claim 4, wherein the rare-earth element R comprises at least one element selected from the group consisting of Nd, and Pr.

6. The RFeB sintered magnet according to claim 1, including 0.2% by mass or less of Ga as an unavoidable impurity.

7. The RFeB sintered magnet according to claim 1, wherein the rare-earth element R is provided in a range from 29% to 32% by mass.

8. The RFeB sintered magnet according to claim 7, wherein Co is provided in a range from 0.90% to 1.5% by mass.

9. The RFeB sintered magnet according to claim 8, wherein Al is provided in a range from 0.4% to 0.5% by mass.

10. The RFeB sintered magnet according to claim 9, wherein O is provided less than 1,000 ppm.

11. The RFeB sintered magnet according to claim 10, wherein Zr is provided in a range from 0.05% to 0.35% by mass.

12. The RFeB sintered magnet according to claim 1, wherein Co is provided in a range from 0.90% to 1.5% by mass.

13. The RFeB sintered magnet according to claim 1, wherein Al is provided in a range from 0.4% to 0.5% by mass.

14. The RFeB sintered magnet according to claim 1, wherein O is provided less than 1,000 ppm.

15. The RFeB sintered magnet according to claim 1, wherein Zr is provided in a range from 0.05% to 0.35% by mass.

16. The RFeB sintered magnet according to claim 1, wherein the RFeB sintered magnet is produced by a first aging treatment by heating in a range from 700° C. to 900° C. followed by a second aging treatment by heating in a range from 530° C. to 580° C.

17. The RFeB sintered magnet according to claim 16, wherein the second aging treatment is performed in a range from 560° C. to 580° C.

18. The RFeB sintered magnet according to claim 1, wherein, in the RFeB sintered magnet, an R-rich phase other than the RFeAl phase is present in the crystal grain boundary, the R-rich phase including a phase in which a content of the rare-earth element R is higher than a content of the rare-earth element R in $R_2Fe_{14}B$ that constitutes crystal grains of the RFeB sintered magnet.

* * * * *